US005985168A

United States Patent [19]

Phule

[11] Patent Number: 5,985,168

[45] Date of Patent: Nov. 16, 1999

[54] MAGNETORHEOLOGICAL FLUID

[75] Inventor: Pradeep P. Phule, Pittsburgh, Pa.

[73] Assignee: University of Pittsburgh of the Commonwealth System of Higher Education, Pittsburgh, Pa.

[21] Appl. No.: 09/070,073

[22] Filed: Apr. 30, 1998

Related U.S. Application Data

[60] Provisional application No. 60/060,296, Sep. 29, 1997, abandoned.

[51] Int. Cl.[6] ..... H01F 1/44

[52] U.S. Cl. ..... 252/62.52; 252/65.54; 252/62.56; 252/62.55; 252/62.62; 252/62.51 R; 252/62.51 C

[58] Field of Search ..... 252/62.52, 62.54, 252/62.56, 62.51 R, 62.51 C, 62.62, 62.55

[56] References Cited

U.S. PATENT DOCUMENTS

| | | | |
|---|---|---|---|
| 4,687,596 | 8/1987 | Borduz et al. | 258/510 |
| 4,992,190 | 2/1991 | Shtarkman | 252/62.52 |
| 5,167,850 | 12/1992 | Shtarkman | 252/62.52 |
| 5,284,330 | 2/1994 | Carlson et al. | 267/140.14 |
| 5,354,488 | 10/1994 | Shtarkman et al. | 252/62.52 |
| 5,382,373 | 1/1995 | Carlson et al. | 252/62.55 |
| 5,398,917 | 3/1995 | Carlson et al. | 267/140.14 |
| 5,505,880 | 4/1996 | Kormann et al. | 252/62.54 |
| 5,578,238 | 11/1996 | Weiss et al. | 252/62.52 |
| 5,645,752 | 7/1997 | Weiss et al. | 252/62.52 |
| 5,667,715 | 9/1997 | Foister | 252/62.52 |
| 5,711,746 | 1/1998 | Carlson | 428/112 |

OTHER PUBLICATIONS

K. Raj et al., "Magnetic–fluid seals", *Laser Focus*, Apr. 1979, pp. 56–63.

A.M. Homola et al., "Novel Magnetic Dispersions Using Silica Stabilized Particles", *IEEE Transactions on Magnetics*, Sep. 1986, pp. 716–719, vol. Mag. 22, No. 5. no month.

W. Kordonsky, "Elements and Devices Based on Magnetorheological Effect", *Journal of Intelligent Material Systems and Structures*, Jan. 1993, pp. 65–69, vol. 4.

A. Pinkos et al., "An Actively Damped Passenger Car Suspension System with Low Voltage Electro–Rheological Magnetic Fluid", *SAE Technical Paper Series*, International Congress and Exposition, Mar. 1–5, 1993, pp. 86–93.

CL. Kormann et al., "Magnetorheological Fluids With Nano–Sized Particles for Fast Damping Systems", Presented at ACTUATOR 94, Jun. 16, 1994, pp. 1–4.

J.D. Carlson et al., "A growing attraction to magnetic fluids", *Machine Design*, Aug. 8, 1994, pp. 61–64.

H. Janocha et al., "Measurements of MR–Fluids using Rotational Viscometers", *Rheology 94*, Dec. 1994, pp. 198–302.

R. Bolter et al., "Design of Magnetorheological Fluid Actuators", Presented at ACTUATOR 96, 5th International Conference of New Actuators, Jun. 26–28, 1996, pp. 329–332.

M.R. Jolly et al., "Controllable Squeeze Film Damping Using Magnetorheological Fluid", Presented at ACTUATOR 96, 5th International Conference on New Actuators, Jun. 26–28, 1996, pp. 333–336.

X. Tang et al., "Quasistatic measurements on a magnetorheological fluid", *J. Rheol.*, Nov./Dec. 1996, pp. 1167–1178, vol. 40, No. 6.

K.D. Weiss et al., "High Strength Magneto–and Electro–rheological Fluids", pp. 425–430, Lord Corp. no month.

J.M. Ginder, "Rheology Controlled By Magnetic Fields", *Encyclopedia of Applied Physics*, pp. 1–35. no month.

J.M. Ginder et al., "Rheology of Magnetorheological Fluids: Models and Measurements", *Proc. of the 5th Int. Conf. on ER Fluids and MR Suspensions*, pp. 1–11, ed. by W. A. Bullough (World Scientific). no month.

*Primary Examiner*—C. Melissa Koslow

*Attorney, Agent, or Firm*—Alan G. Towner; Arnold B. Silverman; Eckert Seamans Cherin & Mellott, LLC

[57] ABSTRACT

A magnetorheological (MR) fluid including magnetically soft particles suspended in a carrier solvent is disclosed. The MR fluid also includes additive particles of smaller size than the magnetically soft particles and a bridging polymer. The additive particles and polymer form a gel-like material which provides a blanket or coating around the magnetically soft particles. The MR fluids possess improved stability and redispersibility, as well as favorable mechanical properties.

43 Claims, 2 Drawing Sheets

MAGNETORHEOLOGICAL FLUID

CROSS REFERENCE TO RELATED APPLICATION

This application claims the benefit of U.S. Provisional Application Ser. No. 60/060,296 filed Sep. 29, 1997, now abandoned.

FIELD OF THE INVENTION

The present invention relates to magnetorheological fluids, and more particularly relates to magnetorheological fluids possessing substantially enhanced stability and redispersibility.

BACKGROUND INFORMATION

Magnetorheological (MR) fluids consist of dispersions of magnetically soft particles in a liquid. Particles of the magnetically dispersed phase are magnetically soft in order to allow for reversibility of the magnetic effect. At zero magnetic field, the viscosity of the base MR fluid may be on the order of 0.1–0.7 Pa•sec and the fluid exhibits ideal Newtonian behavior, i.e. shear stress is directly proportional to shear rate. However, under a magnetic field, a substantial increase in yield stress can occur. The applied field induces a dipole moment in each particle causing the formation of pearl-like chains which form in the direction of the magnetic field. The substantial increase in yield stress is both rapid (within milliseconds) and nearly reversible. This fibril formation is responsible for the observable shear stresses which allow MR fluids to be used for applications such as vibrational dampers, clutches, brake systems, shock absorbers and variable resistance apparatuses.

Magnetorheological (MR) fluids and electrorheological (ER) fluids were originally discovered in the late 1940's. However, research on MR fluids ceased while development of their electric analog continued. This was probably because the large particle sizes of the magnetically active phase of MR fluids led to a strong tendency for the particles to settle out of the liquid phase. Recently, there has been a renewed interest in MR fluids, probably due to the fact that MR fluids can obtain yield stresses approximately two magnitudes larger than ER fluids (~100 kPa for MR fluids compared to ~3 kPa for ER fluids). MR fluids hold many other advantages over ER fluids advantages as well. MR fluids have a high tolerance of common impurities such as water, stability over a wide temperature range (−40 to 150° C.), and the ability to use low voltage power supplies (12 volts). ER fluids, on the other hand, are relatively less tolerant of impurities, which means strict control of processing is required. Furthermore, the need for bulky, high voltage power supplies (5,000 volts) associated with ER fluids can pose a number of design and safety problems. The ER fluids also often lose their strength as their temperature increases.

There are some significant problems associated with conventional MR fluids. One disadvantage is that dispersed particles in MR fluids settle down as a result of gravitational or centrifugal sedimentation. Another related problem is that the settled particles form a tightly knit sediment or a "cake" which, once formed, makes it extremely difficult to redisperse the MR fluid. These problems arise since iron powders (density of approximately 7.8 g/cm$^3$) and ceramic ferrite powders (density of approximately 5.24 g/cm$^3$) are denser in comparison with the carrier liquids (densities approximately 0.8–1.0 g/cm$^3$).

MR fluids originally based on relatively large coarse iron particles (e.g., greater than 50–100 microns) were unsuitable for practical application since the particles would settle out of the liquid phase. Recently, there has been renewed interest in the applications of MR fluids. One of the possible reasons for this is the lack of success in development of the electrical counterpart ER fluids. Also, certain specific applications such as high torque rotary couplings could only be possible with MR fluids.

Researchers have reported magnetic or ferrofluids based on nano-sized magnetic particles having diameters of less than 30 nm. When particle sizes reach 5 to 10 nm, the dispersion acts as a ferrofluid where there is no observable yield stress but rather the entire sample undergoes a body force proportional to the magnetic field gradient. Ferrofluids, behave like liquid magnets and are distinguishable from MR fluids. Ferrofluids are currently being utilized as hermetic seals.

U.S. Pat. No. 5,505,880 to Kormann et al. discloses the use of sodium salt of polyacrylic acid of molecular weight 4,000 and water, along with ethylene glycol or other liquids as a carrier, to prepare MR fluids based on manganese zinc ferrite and other magnetic particles of size less than 1 micron. These types of fluids, although relatively stable against settling, have two undesired characteristics. The first is the yield stress of these fluids is relatively low (approximately maximum 6 kPa). The lack of adequate yield stress will mean that these MR fluids will not be useful for several applications. Furthermore, since the magnetic particles used are ultrafine, the temperature dependence of the yield stress for these fluids is very significant, which poses challenges in designing devices. Furthermore, these fluids contain water and a complicated process is needed to remove the water if anhydrous MR fluids are desired. The presence of water is often a disadvantage because of corrosion problems. Although stable suspensions may be obtained using these fluids, there is an overall decrease in yield stress (maximum yield stress of about 6 kPa).

Another approach disclosed in U.S. Pat. No. 5,354,488 to Shtarkman et al. uses a non-magnetic carbon dispersant, not greater than 10 nm in size, added to MR fluids to enhance their stability. Shtarkman et al. have referred to these materials as electrorheological magnetic (ERM) fluids. Other dispersants such as boron, aluminum, non-magnetic iron, silicon, germanium, and carbides, nitrides, oxides of aluminum, boron, germanium, hafnium, iron, silicon, tantalum, tungsten, yttrium and zirconium, as well as silicon and siloxane organic polymers, non-silicon containing organic polymers, silica-siloxane polymers and mixtures thereof are also disclosed. The MR fluids prepared using such dispersants are stated to be useful in avoiding the so-called "stick-slip" behavior demonstrated by other MR fluids in which the magnetic phase and the carrier fluids separate out, once the magnetic field is applied. In the process disclosed in U.S. Pat. No. 5,354,488, magnetic particles are first mixed with those of the dispersant, and then the carrier fluid is added to prepare the MR fluid. The dispersant particles are stated to be reversibly bound to the magnetic particles by van der Waals forces. The preferred volume of the dispersant was 1 to 7 volume percent based on the volume of magnetic particles. The overall volume of the carrier fluid was about 45 percent. The use of carbon black as a dispersant for MR fluids is also disclosed in U.S. Pat. No. 4,687,596 to Borduz et al.

In U.S. Pat. No. 5,167,850 to Shtarkman, the difference between a dispersant, as discussed above, and a surfactant is disclosed. Surfactants such as ferrous oleates, ferrous napthalates, aluminum tristearates, lithium stearates, sodium stearates, oleic acid, petroleum sulfonates and phosphate esters, almost all of which have been described in the prior art concerning the so-called ferrofluids, could be used in combination with a carbon dispersant for preparing MR fluids.

U.S. Pat. No. 5,398,917 to Carlson et al. and U.S. Pat. No. 5,645,752 to Weiss et al. disclose surfactants and dispersants similar to those discussed above, although no specific examples of dispersants are included. In addition, U.S. Pat. No. 5,398,917 also mentions that particle settling in MR fluids can be minimized by the addition of silica, and that the silica will form a thixotropic network that helps reduce settling of particles. U.S. Pat. No. 5,398,917 also notes that other low molecular weight hydrogen bonding molecules such as water, and other molecules containing hydroxyl, carbonyl, or amine functionality can be used to assist the formation of a thixotropic network. Thus, the low molecular weight agents could consist of water, methyl, ethyl, propyl, isopropyl, butyl, and hexyl alcohols, ethylene glycols, diethylene glycol, propylene glycol, glycerols, amino alcohols and amino esters from 1–16 carbon atoms in the molecule, several types of silicone oligomers, and mixtures thereof. In the examples of U.S. Pat. No. 5,398,917, stearic acid is used as a surfactant and no mention is made of the use of any dispersant. The use of silica as a dispersant for magnetic recording materials as gamma iron oxide has also been previously described.

U.S. Pat. No. 5,578,238 to Weiss et al. discloses the cleaning of surfaces of magnetic particles using chemical or physical processes. This patent also discusses the use of plastics, metals or ceramics to protect the surfaces from corrosion. Examples of metallic materials used to modify the particles surface include titanium, zirconium, hafnium, vanadium, niobium, tantalum, chromium, molybdenum, tungsten, copper, silver, gold, lead, tin, zinc, cadmium, cobalt-based intermetallic alloys and nickel-based intermetallic alloys. Examples of plastics used to protect the magnetic materials surface include acrylics, cellulosics, polyphenylene sulfides, polyquinoxilines and polybenzimidazoles. The goal of deposition of such coatings is to protect the magnetic particles from corrosion. This, for example, may be important in magnetorheological fluids containing water.

Each of the above-referenced patents is incorporated herein by reference.

The present invention has been developed in view of the foregoing and to address other deficiencies of the prior art.

SUMMARY OF THE INVENTION

The present invention provides MR fluids having excellent stability and redispersibility. The MR fluids comprise magnetic and colloidal particles that are at least partially coated using a polymer and are suspended in a liquid. The coating is made from a gel-like material and is preferably made by polymeric flocculation of nanostructured additive particles such as silica.

An object of the present invention is to provide MR fluids including a solvent and magnetically soft particles at least partially covered with additive particles bridged with a polymer suspended in the solvent.

Another object of the present invention is to provide MR fluids including a solvent, magnetically soft particles, additive particles having an average size smaller than the average size of the magnetically soft particles, and a polymer.

Another object of the present invention is to provide a method of making MR fluids. The method includes the steps of mixing additive particles with a solvent, mixing soft magnetic particles with the mixture of additive particles and solvent, and introducing a bridging polymer to the mixture of magnetic particles, additive particles and solvent. The polymer and at least a portion of the additive particles form a gel-like material which at least partially covers the magnetically soft particles.

Another object of the present invention is to provide MR fluids that are based on magnetic particles, typically having average sizes of from about 1 to about 100 microns, which possess very good stability against sedimentation as well as excellent redispersibility.

Another object of the present invention is to provide MR fluids which possess excellent mechanical properties such as yield stress.

Another object of the present invention is to provide MR fluids having lubricated particle surfaces and hence low abrasiveness.

Another object of the present invention is to provide MR fluids that are substantially water free and non-corrosive.

Another object of the present invention is to provide MR fluids that have good temperature stability.

The present invention provides a MR fluid in which magnetic particles suspended in a liquid are coated with a gel-like material. The gel-like coating is preferably produced using a polymer that can be dissolved in the carrier liquid and a nano-structured colloidal additive particle material. These fluids may additionally contain other solvents that can be used to dissolve the polymer. Water is not required at any stage during the preferred synthesis of the MR fluids. The nanostructured additive particles interact with the polymer and form a gel-like material that coats the magnetic particles. The coating is preferably permanent and provides MR fluids that are stable against settling and are readily redispersible. The coating also lubricates the surfaces of the particles and lowers their abrasiveness.

These and other objects of the present invention will become more apparent from the following description.

DETAILED DESCRIPTION OF PRIOR ART

Figure 1:
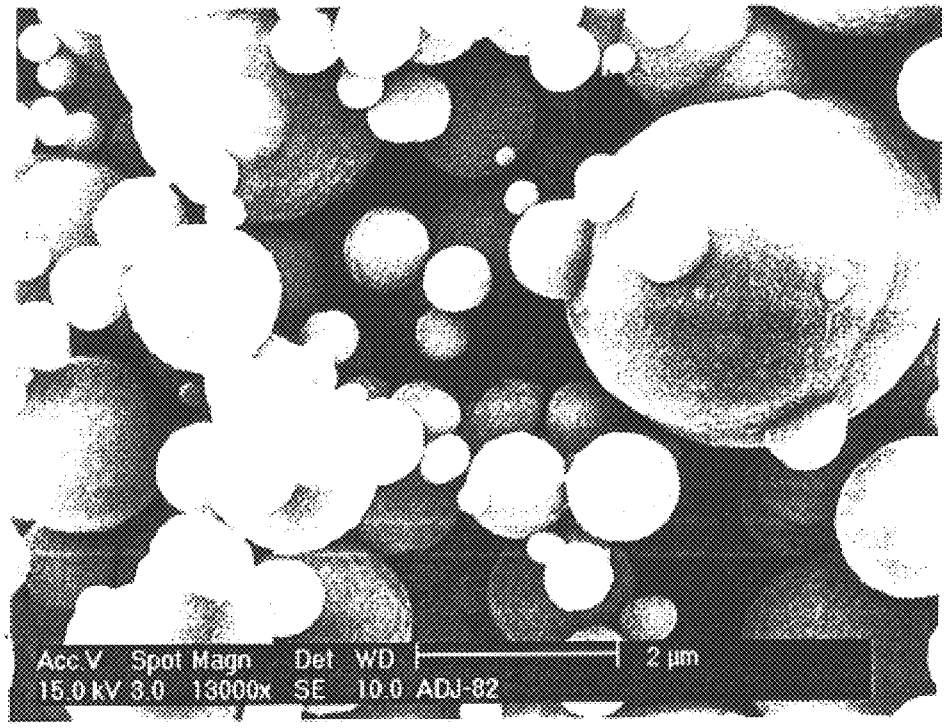
FIG. 1 is a photomicrograph showing iron particles from a conventional MR fluid.

The MR fluids of the present invention comprise magnetically soft particles, additive particles, and a polymer in a solvent. The polymer and at least a portion of the additive particles form a gel-like material which provides a blanket or coating around the magnetically soft particles. The gel-like coating substantially increases the stability and redispersibility of the MR fluids, and acts as a lubricant for the particle surfaces.

The composition of the present MR fluids is variable within certain ranges. The preferred solids content of the magnetically soft particles in the MR fluid is from about 5 to about 80 percent by volume (e.g., from about 29 to about 97 percent by weight for Fe), more preferably from about 20 to about 60 volume percent (e.g., from about 66 to about 92 percent by weight for Fe). As understood by those skilled in the art, the weight percentage will vary for different magnetic materials. Expressed in terms of weight percent, for many types of magnetically soft compositions, the solids content of the magnetically soft particles in the MR fluid is preferably from about 20 to about 98 weight percent, more preferably from about 50 to about 95 weight percent. The preferred solids content of nanostructured additive particles in the carrier phase is from about 0.1 to about 20 percent by weight, more preferably from about 1 to about 12 weight percent. The preferred polymer content in the MR fluid is from about 0.1 to about 10 percent by weight, more preferably from about 0.1 to about 1 weight percent. Additional solvents, if used, preferably comprise less than about 20 weight percent of the MR fluid.

In accordance with the present invention, the magnetically soft particles of the MR fluid may comprise iron, nickel, cobalt, iron oxide, gamma iron oxide, iron cobalt, iron nickel, iron silicon, manganese zinc ferrite, zinc nickel ferrite, chrome oxide, iron nitride, vanadium alloys, tungsten alloys, copper alloys, manganese alloys, and any other suitable magnetically soft particles. The soft magnetic particles typically have an average particle size from about 1 to about 100 microns, preferably from about 1 to about 20 microns.

The additive particles of the present MR fluids are preferably nanostructured materials such as oxides, carbides, nitrides and borides. Oxide additive particles are suitable for many of the present MR fluids. Preferred particulate additives include $SiO_2$, $TiO_2$, $ZrO_2$, and $Fe_3O_4$. The additive particles are capable of being linked by polymers, and typically have an average particle size substantially smaller than the size of the magnetically soft particles. Preferably, the additive particles have an average size from about $10^{-5}$ to about the average size of the soft magnetic particles. The average particle size of the additive particles is typically from about 1 to about 1,000 nm, preferably from about 1 to about 100 nm, with a particle size of from about 10 to about 20 nm being suitable for many applications. The weight ratio of the additive particles to the magnetically soft particles is typically about 0.004 to about 0.4, preferably from about 0.01 to about 0.05.

The bridging polymer of the present MR fluids is selected such that it forms bridges or links between the additive particles. The bridging polymer preferably has the ability to adsorb on the additive particles such as silica, and also may adsorb on the surfaces of the magnetically soft particles. Suitable polymers include linear or branched polymeric materials such as polyvinylpyrrolidone (PVP), polyethyleneamine, poly(4-vinylpyridine) and the like. The polymers are preferably long enough to bridge the distance between the additive particles in the MR fluid, and are preferably capable of adsorbing on metal and/or metal oxide surfaces of the particles. Furthermore, the bridging polymers should promote sufficient stability and redispersibility of the MR fluid, and are preferably silicon-free. While not intending to be bound by any particular theory, it is believed that the present bridging polymers coat or adsorb on the surfaces of the silica or other additive particles without the necessity of the formation of hydrogen bonds. The weight ratio of the bridging polymer to the additive particles is typically from about 0.01 to about 1, preferably from about 0.05 to about 1.

The solvent of the present MR fluids is any suitable solvent, preferably an organic liquid. Polar organic liquids are one type of organic liquid that may be used. Preferably, the solvent has a relatively high boiling point so that the solvent does not evaporate in use. Suitable solvents include MR carrier fluids known in the art such as ethylene glycol, ethylene glycol ethers, mineral oils, machine oils, silicone oils and the like. The solvent typically comprises from about 1 to about 50 weight percent of the MR fluid, preferably from about 4 to about 15 weight percent. In the preferred embodiment, the solvent is substantially free of water.

The present MR fluids have very good stability against sedimentation and very good redispersibility. For example, after two to six months the MR fluids exhibit substantially no sedimentation and are dispersed easily using very low shear, such as that applied using a small spatula. Compared to this, conventional MR fluids that do not contain the polymer or the nano-structured additive or both show sedimentation of magnetic particles within a few hours, and are extremely difficult to redisperse.

The present MR fluids also possess favorable magnetic properties. Under no magnetic field, the MR fluids typically have a yield stress of from about 0.1 kPa to about 1 kPa. When the MR fluid is introduced into a magnetic field (e.g., B=1 Tesla), its yield stress typically increases to a level of greater than about 0.2 kPa, preferably from about 2 to about 130 kPa or higher. The MR fluid preferably undergoes an increase in yield stress on the order of at least about 100 times when subjected to a magnetic field. The magnetically soft particles are substantially uniformly redispersible in the solvent after a magnetic field is removed from the fluid.

The following examples illustrate various aspects of the present invention, and are not intended to limit the scope of the invention.

EXAMPLE 1

A comparative example is performed as follows. A 40 volume percent (83.9 weight percent) iron-based MR fluid is prepared as follows. Iron powder 286.0 g (Grade R-1430 micropowder iron manufactured by ISP Technologies Inc.) having an average particle size of about 5–7 microns is dispersed in 57.8 grams of ethyleneglycol dimethyl ether carrier fluid. The calculated masses of the powder and solvent are weighed out using an Ohaus Model CT1200 digital scale. The solvent is then added to a 125 milliliter Nalgene container. The container is then placed in a clamp on a ring stand and adjusted so that the blades of the General Signal Lightning L1UO8 mixer are as close to the bottom of the container as possible without touching. The mixer speed is then set at 600 rpm and the powder is slowly added to the solvent. The resultant mixture is then stirred at 100 rpm for 10 minutes. After thorough mixing, 150 grams of yttria-stabilized zirconia grinding media is added to the MR fluid, and then the container is sealed. The Nalgene bottle is then placed in a padded coffee can and placed on a ball mill for 24 hours in order to reduce any particle agglomeration and to homogenize the sample. Following the milling, the grinding medium is separated from the MR fluid using a mesh screen. The MR fluid is then returned to the bottle and a wax film (parafilm) is placed over the mouth before replacing the cap. FIG. 1 shows an SEM micrograph of an iron-based MR fluid similar to that produced in Example 1. In this case, there is no coating on the magnetic particles. In this sample, the magnetic particles begin to settle almost immediately and settling is complete within a few hours. After a few weeks, this sample cannot be dispersed using a low shear.

EXAMPLE 2

Figure 2:
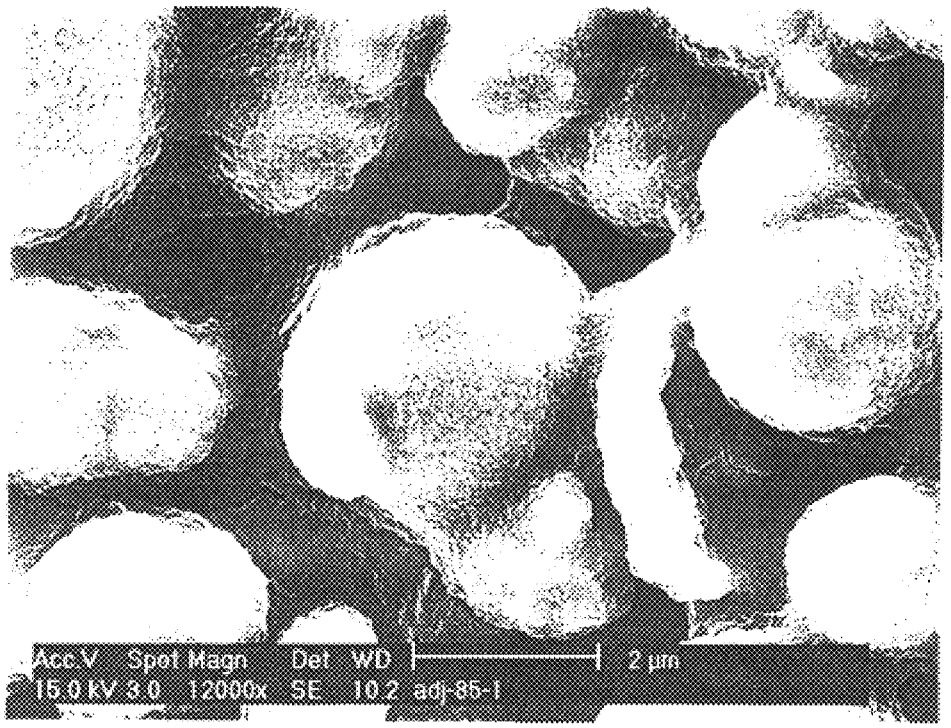
FIG. 2 is a photomicrograph showing iron particles covered with an interconnected blanket of polymer and silica additive particles from a MR fluid in accordance with an embodiment of the present invention.

A 33 volume percent (78.8 weight percent) iron-based MR fluid in accordance with the present invention is prepared as follows. Iron powder 286.0 g (Grade R-1430 micropowder iron manufactured by ISP Technologies Inc.) having an average particle size of about 5–7 microns is dispersed in 57.8 grams of ethyleneglycol dimethyl ether as the carrier fluid. The carrier fluid also contains approximately 20 weight percent of nanostructured silica having an average particle size of about 10 nanometers. The calculated masses of the powders and solvent are weighed out using an Ohaus Model CT1200 digital scale. The solvent is then added to a 125 milliliter Nalgene container. The container is then placed in a clamp on a ring stand and adjusted so that the blades of the General Signal Lightning L1UO8 mixer are as close to the bottom of the container as possible without touching. The mixer speed is then set at 600 rpm and the powder is slowly added to the solvent. Once all of the powder is added the mixer speed is increased to 800 rpm for 2 minutes. One gram of a polymer, polyvinylpyrrolidone (PVP), having an average molecular weight of 29,000 is dissolved in approximately 18 grams of octanol and is then added to the MR fluid after the 800 rpm cycle. The resultant mixture is then stirred at 1,000 rpm for 10 minutes. After thorough mixing, 150 grams of yttria-stabilized zirconia grinding media is added to the MR fluid, and then the container is sealed. The Nalgene bottle is then placed in a padded coffee can and placed on a ball mill for 24 hours in order to reduce any particle agglomeration and to homogenize the sample. Following the milling, the grinding medium is separated from the MR fluid using a mesh screen. The MR fluid is then returned to the bottle and a wax film (parafilm) is placed over the mouth before replacing the cap. Under no magnetic field the MR fluid has a yield stress of about 0.2 kPa. When a magnetic field (B=1 Tesla) is applied to the MR fluid, its yield stress increases to about 80 kPa. FIG. 2 shows an SEM micrograph of the 33 volume percent iron-based MR fluid. In FIG. 2 the coating that is permanently formed on the magnetic particles can be observed. This sample does not show any appreciable settling even after two months. After a period of two to six months, the sample can be easily redispersed using a small spatula.

EXAMPLE 3

Figure 3:
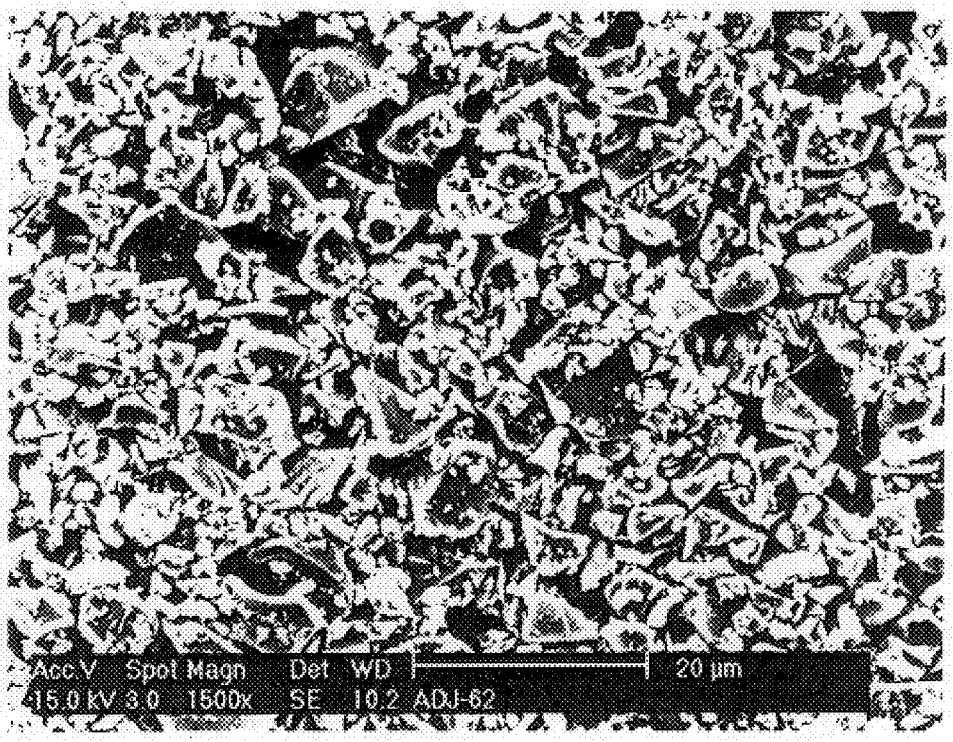
FIG. 3 is a photomicrograph of ferrite particles from a conventional MR fluid.

A comparative example is prepared comprising a 40 volume percent (81.8 weight percent) ferrite MR fluid as follows. Iron oxide-based powder comprising manganese zinc ferrite 260.0 g (Steward Inc.) having an average particle size of about 2 microns is dispersed in 57.8 grams of ethyleneglycol dimethyl ether carrier fluid. The calculated masses of the powder and solvent are weighed out using an Ohaus Model CT1200 digital scale. The solvent is then added to a 125 milliliter Nalgene container. The container is then placed in a clamp on a ring stand and adjusted so that the blades of the General Signal Lightning L1UO8 mixer are as close to the bottom of the container as possible without touching. The mixer speed is then set at 600 rpm and the powder is slowly added to the solvent. Once all of the powder is added the mixer speed is increased to 800 rpm for 2 minutes. The resultant mixture is then stirred at 1,000 rpm for 10 minutes. After thorough mixing, 150 grams of yttria-stabilized zirconia grinding media is added to the MR fluid, and then the container is sealed. The Nalgene bottle is then placed in a padded coffee can and placed on a ball mill for 24 hours in order to reduce any particle agglomeration and to homogenize the sample. Following the milling, the grinding medium is separated from the MR fluid using a mesh screen. The MR fluid is then returned to the bottle and a wax film (parafilm) is placed over the mouth before replacing the cap. FIG. 3 shows an SEM micrograph of the 40 volume percent ferrite-based MR fluid. In this case, there is no coating on the magnetic particles. In this sample, the magnetic particles begin to settle almost immediately. The settling is complete within a few hours. After a few weeks, this sample cannot be dispersed using a low shear.

EXAMPLE 4

Figure 4:
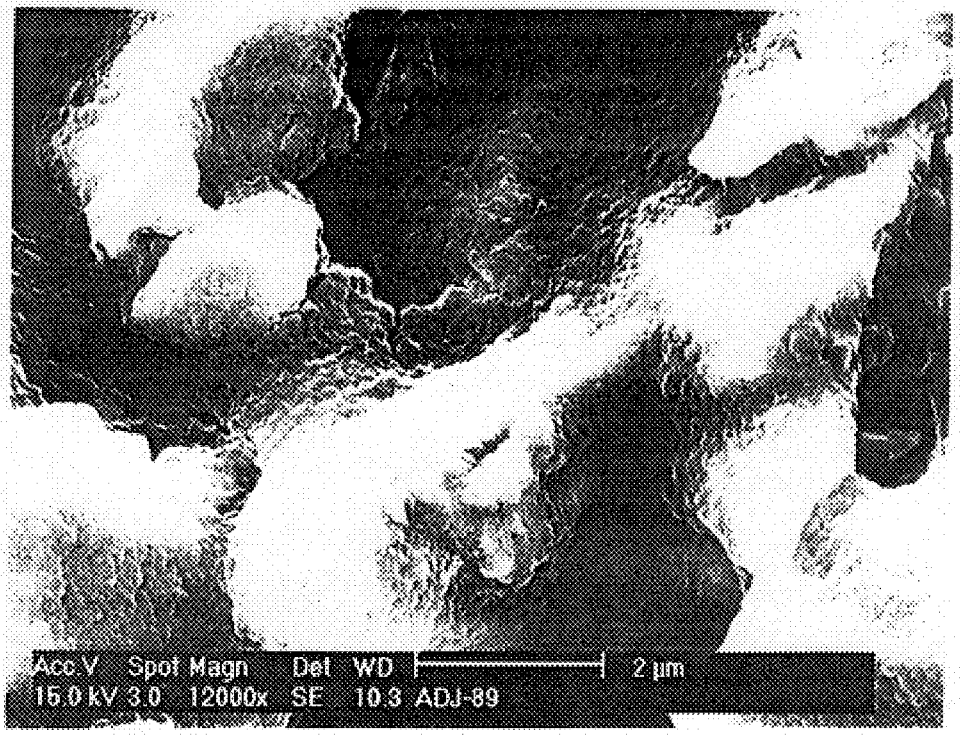
FIG. 4 is a photomicrograph showing ferrite particles covered with an interconnected blanket of polymer and silica additive particles of a MR fluid in accordance with an embodiment of the present invention.

A 33 volume percent (69.1 weight percent) ferrite MR fluid of the present invention is prepared as follows. Iron oxide-based powder comprising manganese zinc ferrite 172 g (Steward Inc.) having an average particle size of about 2 microns is dispersed in 57.8 grams of ethyleneglycol dimethyl ether carrier fluid. The carrier fluid also contains approximately 20 weight percent of nanostructured silica having an average particle size of about 10 nanometers. The calculated masses of the powders and solvent are weighed out using an Ohaus Model CT1200 digital scale. The solvent is then added to a 125 milliliter Nalgene container. The container is then placed in a clamp on a ring stand and adjusted so that the blades of the General Signal Lightning L1UO8 mixer are as close to the bottom of the container as possible without touching. The mixer speed is then set at 600 rpm and the powder is slowly added to the solvent. Once all of the powder is added the mixer speed is increased to 800 rpm for 2 minutes. One gram of a polymer, polyvinylpyrrolidone (PVP), having an average molecular weight of 29,000 is dissolved in approximately 18 grams of the carrier fluid and is then added to the MR fluid after the 800 rpm cycle. The resultant mixture is then stirred at 1,000 rpm for 10 minutes. After thorough mixing, 150 grams of yttria-stabilized zirconia grinding media is added to the MR fluid, and then the container is sealed. The Nalgene bottle is then placed in a padded coffee can and placed on a ball mill for 24 hours in order to reduce any particle agglomeration and to homogenize the sample. Following the milling, the grinding medium is separated from the MR fluid using a mesh screen. The MR fluid is then returned to the bottle and a wax film (parafilm) is placed over the mouth before replacing the cap. Under no magnetic field the MR fluid has a yield stress of about 0.2 kPa. When a magnetic field (B=1 Tesla) is applied to the MR fluid, its yield stress increases to about 8–10 kPa. FIG. 4 shows an SEM micrograph of the 33 volume percent ferrite-based MR fluid. From FIG. 4 the coating that is permanently formed on the magnetic particles can be observed. This sample does not show any appreciable settling even after two to six months. After a period of two to six months, the sample can be easily redispersed using a small spatula.

Table 1 lists some MR fluids of the present invention, along with yield stress properties of the fluids under no magnetic field (B=0) and under a magnetic field of 0.8 Tesla (B=0.8).

TABLE 1

| Magnetic material | Volume fraction magnetic material | Weight percent magnetic material | Magnetic material (g) | Solvent (g) ethylene glycol ether | Solvent (g) octanol | Polymer | Polymer (g) | Yield Stress (kPa) B = 0 | Yield Stress (kPa) B = 0.8 |
|---|---|---|---|---|---|---|---|---|---|
| Fe | 0.33 | 78.2 | 211.5 | 57.8 | 0 | PVP | 1.05 | 0.50 | 104 |
| Fe | 0.4 | 83.7 | 399.5 | 57.8 | 18.0 | PVP | 2 | 0.08 | 114 |
| Fe | 0.4 | 83.9 | 399.5 | 57.8 | 18.0 | PVP | 1.05 | 0.08 | 122 |
| Fe | 0.33 | 78.6 | 286 | 57.8 | 18.0 | PVP | 2 | 0.18 | 97 |
| NiZn ferrite | 0.33 | 71.4 | 192.1 | 57.8 | 18.0 | PVP | 1.05 | 0.23 | 8 |

The MR fluids listed in Table 1 exhibit favorable magnetic properties, and possess excellent stability and redispersibility.

While particular embodiments of the present invention have been described, it is to be understood that various changes, modifications and additions may be made within the scope of the present invention set forth in the following claims.

What is claimed is:

1. A magnetorheological fluid comprising:

(a) a solvent; and (b) magnetically soft particles at least partially covered with additive particles bridged with a polymer suspended in the solvent, wherein the polymer comprises linear or branched molecules which are long enough to bridge the distance between the additive particles in the magnetorheological fluid to thereby form an interconnected blanket of the polymer and additive particles.

2. The magnetorheological fluid of claim 1, wherein the additive particles have an average size smaller than an average size of the magnetically soft particles.

3. The magnetorheological fluid of claim 1, wherein the additive particles comprise at least one material selected from the group consisting of oxides, nitrides and borides.

4. The magnetorheological fluid of claim 1, wherein the additive particles comprise silica.

5. The magnetorheological fluid of claim 4, wherein the additive particles have an average size of from about 1 to about 1,000 nanometers, and the magnetically soft particles have an average size of from about 1 to about 100 microns.

6. The magnetorheological fluid of claim 1, wherein the magnetically soft particles comprise at least one material selected from the group consisting of iron, nickel, cobalt, iron oxide, iron cobalt, iron nickel, iron silicon, manganese zinc ferrite, zinc nickel ferrite, chrome oxide, iron nitride, vanadium alloys, tungsten alloys, copper alloys and manganese alloys.

7. The magnetorheological fluid of claim 1, wherein the polymer is adsorbed or coated on the additive particles.

8. The magnetorheological fluid of claim 1, wherein the polymer comprises at least one material selected from the group consisting of polyvinylpyrrolidone, polyethyleneamine and poly(4-vinylpyridine).

9. The magnetorheological fluid of claim 1, wherein the solvent comprises at least one organic liquid.

10. The magnetorheological fluid of claim 1, wherein the solvent comprises at least one liquid selected from the group consisting of ethylene glycol, ethylene glycol ethers, octanol, mineral oils, machine oils and silicone oils.

11. The magnetorheological fluid of claim 1, wherein the solvent is substantially free of water.

12. A magnetorheological fluid comprising:

(a) a solvent;

(b) magnetically soft particles;

(c) additive particles having an average size smaller than an average size of the magnetically soft particles; and (d) a polymer comprising at least one material selected from the group consisting of polyvinylpyrrolidone, polyethyleneamine and poly(4-vinylpyridine).

13. The magnetorheological fluid of claim 12, wherein the magnetically soft particles comprise from about 20 to about 98 weight percent of the fluid, the additive particles comprise from 0.1 to about 20 weight percent of the fluid, and the polymer comprises from about 0.1 to about 10 weight percent of the fluid.

14. The magnetorheological fluid of claim 12, wherein the magnetically soft particles comprise from about 50 to about 95 weight percent of the fluid, the additive particles comprise from 1 to about 12 weight percent of the fluid, and the polymer comprises from about 0.1 to about 1 weight percent of the fluid.

15. The magnetorheological fluid of claim 12, wherein the solvent comprises from about 1 to about 50 weight percent of the fluid.

16. The magnetorheological fluid of claim 12, wherein the solvent comprises from about 4 to about 15 weight percent of the fluid.

17. The magnetorheological fluid of claim 12, wherein the additive particles comprise at least one material selected from the group consisting of oxides, nitrides and borides.

18. The magnetorheological fluid of claim 12, wherein the additive particles comprise silica.

19. The magnetorheological fluid of claim 12, wherein the additive particles have an average size of from about 1 to about 1,000 nanometers, and the magnetically soft particles have an average size of from about 1 to about 100 microns.

20. The magnetorheological fluid of claim 12, wherein the magnetically soft particles comprise at least one material selected from the group consisting of iron, nickel, cobalt, iron oxide, iron cobalt, iron nickel, iron silicon, manganese zinc ferrite, zinc nickel ferrite, chrome oxide, iron nitride, vanadium alloys, tungsten alloys, copper alloys and manganese alloys.

21. The magnetorheological fluid of claim 12, wherein the polymer is adsorbed or coated on the additive particles.

22. The magnetorheological fluid of claim 12, wherein the solvent comprises at least polar organic liquid.

23. The magnetorheological fluid of claim 12, wherein the solvent comprises at least one liquid selected from the group consisting of ethylene glycol, ethylene glycol ethers, octanol, mineral oils, machine oils and silicone oils.

24. The magnetorheological fluid of claim 12, wherein the solvent is substantially free of water.

25. The magnetorheological fluid of claim 12, wherein the fluid has a yield stress of from about 0.1 kPa to about 1 kPa under no magnetic field, and a yield stress of greater than about 2 kPa under a magnetic field.

26. The magnetorheological fluid of claim 12, wherein the yield stress of the fluid increases at least 100 times when introduced into a magnetic field.

27. The magnetorheological fluid of claim 12, wherein the fluid exhibits substantially no sedimentation of the magnetically soft particles in the solvent.

28. The magnetorheological fluid of claim 12, wherein the magnetically soft particles are substantially uniformly redispersible in the solvent after a magnetic field is removed from the fluid.

29. A method of making a magnetorheological fluid comprising the steps of:

(a) mixing additive particles with a solvent;

(b) mixing soft magnetic particles with the mixture of additive particles and solvent; and (c) introducing a bridging polymer to the mixture of magnetic particles, additive particles and solvent.

30. The method of claim 29, wherein the additive particles have an average size smaller than an average size of the magnetically soft particles.

31. The method of claim 30, wherein the additive particles have an average size of from about 1 to about 1,000 nanometers, and the magnetically soft particles have an average size of from about 1 to about 100 microns.

32. The method of claim 29, wherein the additive particles comprise at least one material selected from the group consisting of oxides, nitrides and borides.

33. The method of claim 24, wherein the additive particles comprise silica.

34. The method of claim 29, wherein the magnetically soft particles comprise at least one material selected from the group consisting of iron, nickel, cobalt, iron oxide, iron cobalt, iron nickel, iron silicon, manganese zinc ferrite, zinc nickel ferrite, chrome oxide, iron nitride, vanadium alloys, tungsten alloys, copper alloys and manganese alloys.

35. The method of claim 29, wherein the polymer is adsorbed or coated on the additive particles.

36. The method of claim 29, wherein the polymer comprises at least one material selected from the group consisting of polyvinylpyrrolidone, polyethyleneamine and poly(4-vinylpyridine).

37. The method of claim 29, wherein the solvent comprises at least one liquid selected from the group consisting of ethylene glycol, ethylene glycol ethers, octanol, mineral oils, machine oils and silicone oils.

38. The method of claim 29, wherein the solvent is substantially free of water.

39. The method of claim 29, wherein the magnetically soft particles comprise from about 20 to about 98 weight percent of the fluid, the additive particles comprise from 0.1 to about 20 weight percent of the fluid, and the polymer comprises from about 0.1 to about 10 weight percent of the fluid.

40. The method of claim 29, wherein the magnetically soft particles comprise from about 50 to about 95 weight percent of the fluid, the additive particles comprise from 1 to about 12 weight percent of the fluid, and the polymer comprises from about 0.1 to about 1 weight percent of the fluid.

41. The method of claim 29, wherein the solvent comprises from about 1 to about 50 weight percent of the fluid.

42. The method of claim 29, wherein the solvent comprises from about 4 to about 15 weight percent of the fluid.

43. A magnetorheological fluid comprising:

(a) a solvent; and (b) magnetically soft particles at least partially covered with additive particles bridged with a polymer suspended in the solvent, wherein the polymer comprises at least one material selected from the group consisting of polyvinylpyrrolidone, polyethyleneamine and poly (4-vinylpyridine).

* * * * *